United States Patent [19]

Braun

[11] Patent Number: 4,637,042

[45] Date of Patent: Jan. 13, 1987

[54] X-RAY TUBE TARGET HAVING ELECTRON PERVIOUS COATING OF HEAT ABSORBENT MATERIAL ON X-RAY EMISSIVE SURFACE

[75] Inventor: Martin Braun, San Jose, Calif.

[73] Assignee: The Machlett Laboratories, Incorporated, Stamford, Conn.

[21] Appl. No.: 308,879

[22] Filed: Oct. 5, 1981

Related U.S. Application Data

[63] Continuation of Ser. No. 141,526, Apr. 18, 1980, abandoned, which is a continuation of Ser. No. 962,444, Nov. 20, 1978, abandoned.

[51] Int. Cl.[4] ..... H01J 35/08

[52] U.S. Cl. ..... 378/143; 378/144; 313/311

[58] Field of Search ..... 313/60, 330, 311; 378/143, 144

[56] References Cited

U.S. PATENT DOCUMENTS

| | | | |
|---|---|---|---|
| 4,029,828 | 6/1977 | Bildstein et al. | 313/330 |
| 4,037,127 | 7/1977 | Kawai et al. | 313/330 |
| 4,132,917 | 1/1979 | Bildstein et al. | 313/330 |

FOREIGN PATENT DOCUMENTS

| | | | |
|---|---|---|---|
| 0752025 | 1/1967 | Canada | 313/60 |

*Primary Examiner*—Saxfield Chatmon

*Attorney, Agent, or Firm*—John T. Meaney; R. M. Sharkansky

[57] ABSTRACT

An X-ray tube including a tubular envelope having rotatably mounted therein an anode target disc provided with an annular focal track made of X-ray emissive material having an atomic number greater than forty and coated with a heat absorbent layer having a thickness in the range of 2 to 50 micrometers and made of an elemental or a compound material, comprising one or more elements having respective atomic numbers no greater than thirty.

10 Claims, 2 Drawing Figures

X-RAY TUBE TARGET HAVING ELECTRON PERVIOUS COATING OF HEAT ABSORBENT MATERIAL ON X-RAY EMISSIVE SURFACE

This is a continuation of application Ser. No. 141,526, filed Apr. 18, 1980, which is a continuation of application Ser. No. 962,444, filed Nov. 20, 1978, both abandoned.

BACKGROUND OF THE INVENTION

1. Field of the Invention

This invention relates generally to rotating anode X-ray tubes and is concerned more particularly with a rotatable X-ray target having a focal track provided with a heat absorbent coating.

2. Discussion of the Prior Art

Generally, a rotating anode X-ray tube comprises a tubular envelope having therein an electron emitting cathode disposed to beam high energy electrons onto a spaced anode target. The target may comprise an axially rotatable disc having adjacent its outer periphery an annular focal track made of an efficient X-ray emitting material, such as tungsten, for example. Thus electrons beamed from the cathode may be focused onto a focal spot area of the focal track to penetrate into the underlying material and generate X-rays which radiate therefrom and out of the tube.

Most of the electron energy incident on the focal spot area of the focal track is converted to heat energy which could become excessive and damage the surface of the focal track. Consequently, the target disc is rotated at a suitable high angular velocity, such as ten thousand revolutions per minute, for example, to move successive segments of the annular focal track rapidly through the focal spot area aligned with the electron beam. Thus, a one millimeter wide focal spot area on the focal track of a four inch diameter target disc would have successive segments of one millimeter width aligned with the electron beam for only about twenty microseconds, for example.

However, the penetration depth of the incident electrons is dependent on the kinetic energies of the incident electrons and the density of the focal track material. Consequently, when the focal track is made of relatively high density material, such as tungsten, for example, the incident electrons penetrate into only a thin layer of the focal track material adjacent the bombarded surface thereof. Thus, electrons having respective energies of about eighty thousand electron volts penetrate into tungsten material to a depth of only about five micrometers, for example.

As a result, a high quantity of heat is developed adjacent the bombarded surface of a segment in the brief time interval that the segment is aligned with the electron beam. Furthermore, during this brief time interval, the heat cannot diffuse through adjacent focal track material as rapidly as it is developed. Consequently, the surface temperature of the bombarded segment rises sharply to an undesirable high value, and may exceed the melting point of the focal track material. Therefore, the electron energy incident on the focal spot area, which generally is referred to as the instantaneous power rating of the tube, is limited by the rate at which heat is dissipated from the focal spot area of the focal track.

Thus, it is advantageous and desirable to provide a rotating anode X-ray tube with focal track means for increasing dissipation of heat from the focal spot area thereof.

SUMMARY OF THE INVENTION

Accordingly, this invention provides an X-ray tube including a tubular envelope having therein a rotatable anode target provided with an annular focal track made of efficient X-ray emissive material, and a heat absorbent layer of suitable thickness overlying at least the focal track of the target. An electron emitting cathode is disposed to beam high energy electrons through the heat absorbent layer and onto a focal spot area of the focal track, which is aligned with an X-ray transparent window in the tube envelope. The beamed electrons penetrate into the focal track material in the focal spot area to generate X-rays which radiate through the heat absorbent layer and pass in a beam through the X-ray transparent window of the tube.

The X-ray emissive material of the focal track comprises one or more elements in the Periodic Table having respective atomic numbers greater than forty, such as tungsten or molybdenum, for examples. In contrast to the elements having respective atomic numbers less than forty, these higher atomic number elements have relatively greater densities and, consequently, are more efficient emitters of X-rays when excited by penetrating high energy electrons. Due to the greater densities of the higher atomic number elements, the beamed electrons penetrate only a relatively thin layer of the X-ray emissive material adjacent the bombarded surface of the focal track. As a result, a large quantity of heat is developed adjacent the surface of the focal track, particularly in a segment thereof aligned with the electron beam.

Therefore, in accordance with this invention, overlying the bombarded surface of the focal track is a heat absorbent layer having a thickness in the range of two to fifty micrometers, and made of an elemental or a compound material comprising one or more elements having respective atomic numbers no greater than thirty. Preferably, the material of the heat absorbent layer comprises one or more members of the group consisting of boron (B), boron carbide ($B_4C$), boron nitride (BN), beryllium (Be), beryllium carbide ($Be_2C$), beryllium oxide (BeO), carbon (C), silicon carbide (SiC), titanium boride ($TiB_2$), and titanium carbide (TiC). In contrast to the elements having respective atomic numbers greater than thirty, these lower atomic number elements have proportionately less density and, consequently, permit the passage of electrons beamed from the cathode and X-rays generated in the focal track material with only a small loss of energy.

The material of the heat absorbent layer is mechanically and thermally bonded to the focal track material by any convenient means, such as chemical vapor deposition, for example. Thus, the heat developed in the X-ray emissive material adjacent the surface of the focal track will diffuse instantaneously away from the focal spot area into both the focal track material and the heat absorbent layer. Consequently, the heat absorbent layer provides additional means for dissipating heat and reducing the surface temperature of the focal track segment in the focal spot area.

BRIEF DESCRIPTION OF THE DRAWINGS

For a better understanding of the invention, reference is made in the following more detailed description to the accompanying drawings, wherein.

DESCRIPTION OF THE PREFERRED EMBODIMENT

Figure 1:
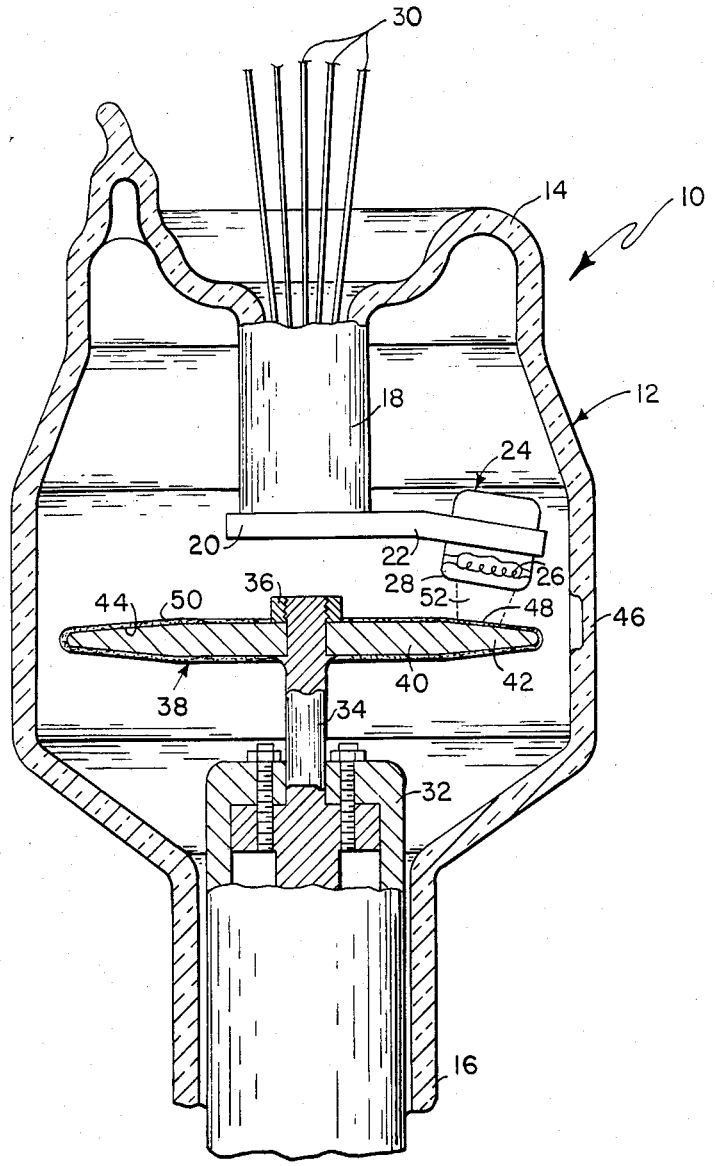
FIG. 1 is a fragmentary elevational view, partly in section, of a rotating anode X-ray tube embodying the invention.

Referring to the drawing wherein like characters of reference designate like parts, there is shown in FIG. 1 an X-ray tube 10 of the rotating anode type having a tubular envelope 12 made of dielectric material, such as glass, for example. Envelope 12 is provided with a reentrant end portion 14 and an opposing neck portion 16. The reentrant end portion of envelope 12 is peripherally sealed to one end of a cathode support sleeve 18 made of rigid material, such as Kovar, for example. Cathode sleeve 18 extends axially within the envelope 12 and has an inner end hermetically sealed to a cap 20 which supports a radially extending, hollow arm 22.

The arm 22 is angulated with respect to the axis of cathode sleeve 18 and supports on a distal end portion thereof a conventional cathode head 24. Cathode head 24 generally includes an electron emitting filament 26 which is longitudinally disposed within a grid-type focusing cup 28. Electrical conductors 30 extend hermetically through the cap 20 and insulatingly through the hollow arm 22 for suitable connection to the filament 26 and the focusing cup 28 in a well-known manner.

Sealed within the neck portion 16 of envelope 12 is a bearing mounted rotor 32 of a magnetic-type induction motor, (the external stator of which is not shown). The rotor 32 extends axially within envelope 12 and has attached to its inner end an axially extending stem 34. Suitably secured, as by hex nut 36, for example, to a distal end portion of stem 34 is a transversely disposed anode target 38, which is rotated by the rotor 32 in a well-known manner.

Figure 2:
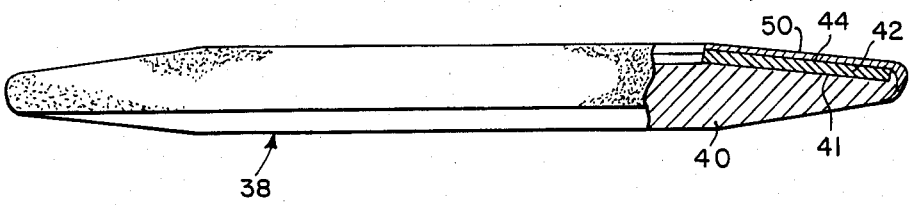
FIG. 2 is an elevational view, partly in section, of an alternative embodiment of the rotating anode shown in FIG. 1.

The anode target 38 includes a substrate disc 40 having adjacent its outer periphery an annular focal track portion 42 provided with a sloped surface 44 adjacent the cathode 24. The X-ray transparent window 46 in the tube envelope 12 is radially aligned with a focal spot area 48 of the focal track surface 44, which is axially aligned with the filament 26 of cathode 24. The focal track portion 42 is made of efficient X-ray emissive material comprising one or more elements having respective atomic numbers greater than forty. Thus, the entire target disc 40 may be made of an efficient X-ray emissive material, such as tungsten, for example. Alternatively, as shown in FIG. 2, the anode target disc 40 may be made of a relatively lightweight material, such as graphite, for example, and have adjacent its periphery an annular sloped surface 41 provided with an overlying focal track layer 42 of efficient X-ray emissive material, such an tungsten-rhenium alloy, for example.

At least the focal track portion 42 of target 38 is provided with an overlying, heat absorbent layer 50 of material comprising one or more elements having respective atomic numbers no greater than thirty. Preferably, the material of heat absorbent layer 50 comprises one or more members of the group consisting of boron (B), boron carbide ($B_4C$), boron nitride (BN), beryllium (Be), beryllium carbide ($Be_2C$), beryllium oxide (BeO), carbon (C), silicon carbide (SiC), titanium boride ($TiB_2$), and titanium carbide (TiC). The material of heat absorbent layer 50 is mechanically and thermally coupled, as by chemical vapor deposition, for example, to the X-ray emissive material of focal track portion 42. Thus, the entire target disc 40 may be coated with the heat absorbent material of layer 50. Alternatively, as shown in FIG. 2, the material of heat absorbent layer 50 may be deposited substantially only on the focal track portion 42 of the target 38.

The material of heat absorbent layer 50 is deposited on the sloped surface 44 of focal track portion 42 in a relatively thin layer having a thickness in the range of two to fifty micrometers. A heat absorbent layer having a thickness of less than two micrometers would severely restrict the heat absorbent capacity of the layer 50. On the other hand, a heat absorbent layer having a thickness greater than fifty micrometers would substantially reduce the intensities of high energy electrons beamed from the cathode 24 and of X-rays emanating from the X-ray emissive material of focal track portion 42. The heat absorbent layer 50 may have the additional advantage of absorbing electrons back-scattered from the focal spot area 48 of focal track portion 42 and thereby reducing the production of off-focus X-rays.

In operation, electrical energy supplied through the conductors 30 heats the filament 26 to an electron emitting temperature, and maintains the focusing cup 28 at a suitable electrical potential for directing the emitted electrons into a beam 52 which impinges on focal spot area 48. The focal spot area 48 may be of conventional size, such as one millimeter wide by five millimeters extended radially along the sloped surface 44, for example. The anode target disc 40 is rotated at an appropriately high angular velocity, such as ten thousand revolutions per minute, for example, to move successive one millimeter wide segments of focal track portion 42 rapidly through the focal spot area 48. Also, the anode target 38 is maintained at a sufficiently high electrical potential, such as eighty thousand volts, for example, with respect to the cathode filament 26 to accelerate electrons in the beam 52 to high kinetic energy levels.

Consequently, the beamed electrons pass through the relatively low density material of heat absorbent layer 50, without substantial loss of energy, and impinge on the focal spot area 48 of focal track portion 42. These high energy electrons penetrate into the high density, X-ray emissive material of focal track portion 42 to generate X-rays which radiate from the focal spot area 48. Thus, generated X-rays also pass through the relatively low density material of heat absorbent layer 50 to travel in a beam through the X-ray transparent window 46 of tube 10.

The resulting heat developed adjacent the surface of focal track portion 42 will diffuse instantaneously away from the focal spot area 48 in two directions, inwardly into the material of focal track portion 42 and outwardly into the material of heat absorbent layer 50. Thus, the heat absorbent layer provides additional means for dissipating heat from the focal track material aligned with the electron beam. Consequently, the surface temperature of the focal track material aligned with the electron beam may be reduced sufficiently to permit as much as a twenty to fifty precent increase in the electron energy impinging on the focal spot area 48. Accordingly, the instantaneous power rating of the tube may be increased to obtain a correspondingly higher X-ray intensity than obtained from conventional X-ray tubes of the prior art.

Thus, there has been disclosed herein an X-ray tube including a tubular envelope wherein a rotatable anode target is provided with an annular focal track made of efficient X-ray emissive material and thermally coupled to an overlying heat absorbent layer made of material comprising one or more elements having respective atomic numbers no greater than thirty. It should be noted that the heat absorbent layer 50 coating the solid target disc 40 made of X-ray emissive material in FIG. 1 may equally well be employed for coating the entire disc 40 and focal track layer 42 shown in FIG. 2. Also, the heat absorbent layer 50 shown covering substantially only the focal track layer 42 in FIG. 2 may equally well be used for coating only the focal track portion 42 of the solid target disc 40 shown in FIG. 1.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described is to be interpreted as illustrative and not in the limiting sense.

What is claimed is:

1. An X-ray tube target including:

a body having focal spot surface portion made of X-ray emissive material comprised of one or more elements having respective atomic numbers greater than forty; and a heat absorbent coating of electron pervious material on the focal spot surface portion and consisting of one or more elements having respective atomic numbers no greater than thirty.

2. An X-ray target as set forth in claim 1 wherein the material of the heat absorbent coating is comprised of one or more members from the group consisting of boron, boron carbide, boron nitride, beryllium, beryllium carbide, beryllium oxide, carbon, silicon carbide, titanium boride, and titanium carbide.

3. An X-ray target as set forth in claim 1 wherein the body is a rotatable disc; and the surface portion is annular and disposed adjacent the outer periphery of the disc.

4. An X-ray target as set forth in claim 3 wherein the annular surface portion is sloped radially.

5. An X-ray target as set forth in claim 3 wherein the surface portion comprises a layer of the X-ray emissive material deposited on the disc.

6. An X-ray target as set forth in claim 1 wherein the heat absorbent coating has a thickness in the range of two to fifty micrometers.

7. An X-ray tube including:

a tubular envelope;

an X-ray target mounted in the envelope and having a focal spot surface portion made of X-ray emissive material comprising one or more elements having respective atomic numbers greater than forty;

a heat absorbent layer of electron pervious material on the focal spot surface portion and consisting of one or more elements having respective atomic numbers no greater than thirty; and means for beaming electrons through the electron pervious material of the heat absorbent layer and into the X-ray emissive material of the focal spot surface portion for generating in the X-ray emissive material X-rays which pass through the electron pervious material of the heat absorbent layer.

8. An X-ray tube as set forth in claim 7 wherein the material of the heat absorbent layer comprises one or more members from the group consisting of boron, boron carbide, boron nitride, beryllium, beryllium carbide, beryllium oxide, carbon, silicon carbide, titanium boride, and titanium carbide.

9. An X-ray tube as set forth in claim 7 wherein the heat absorbent layer has a thickness in the range of two to fifty micrometers.

10. An X-ray tube as set forth in claim 9 wherein the means for beaming electrons includes an electron emitting cathode disposed within the envelope to direct electrons through the heat absorbent layer and into the X-ray emissive material of the focal track portion.

* * * * *